US008590551B2

(12) United States Patent
Uniyal et al.

(10) Patent No.: US 8,590,551 B2
(45) Date of Patent: Nov. 26, 2013

(54) UMBRELLA COVER

(76) Inventors: Upama Uniyal, New York City, NY (US); Enrique Casas, Monrovia, CA (US)

( * ) Notice: Subject to any disclaimer, the term of this patent is extended or adjusted under 35 U.S.C. 154(b) by 115 days.

(21) Appl. No.: 12/462,778

(22) Filed: Aug. 10, 2009

(65) Prior Publication Data

US 2011/0030746 A1 Feb. 10, 2011

(51) Int. Cl.
*A45B 3/00* (2006.01)
*A45B 25/24* (2006.01)

(52) U.S. Cl.
USPC ..... 135/34.2; 135/16

(58) Field of Classification Search
USPC ..... 135/15.1, 16, 18, 34.2; 383/61.3, 4, 97; 150/154; 159/100, 106, 154
See application file for complete search history.

(56) References Cited

U.S. PATENT DOCUMENTS

| | | | | |
|---|---|---|---|---|
| 5,323,802 | A * | 6/1994 | Kiedrowski | 135/34.2 |
| 6,237,776 | B1 * | 5/2001 | Mogil | 206/579 |
| 2002/0114539 | A1 * | 8/2002 | Strevey et al. | 383/13 |
| 2003/0096660 | A1 * | 5/2003 | Ward et al. | 473/299 |
| 2007/0221522 | A1 * | 9/2007 | Yamada et al. | 206/316.2 |
| 2008/0047995 | A1 * | 2/2008 | Psilogenis | 224/577 |

* cited by examiner

*Primary Examiner* — David Dunn
*Assistant Examiner* — Danielle Jackson

(57) ABSTRACT

The cover of the present invention is a holder for a foldable umbrella composed of a sheet of flexible material preferably having an outer and an inner layer and a fastener, preferably a zipper having an open and closed position, affixed to the outer perimeter of the flexible material such that when the zipper is in the closed position the flexible material is configured into an enclosure adapted to hold a foldable umbrella for storage and transportation and when the zipper is in the open position the flexible material is configured into a sheet adapted to be laid flat open on a level surface.

8 Claims, 5 Drawing Sheets

UMBRELLA COVER

FIELD OF THE INVENTION

This invention relates to an umbrella cover or holder for storing and protecting an umbrella, particularly a foldable umbrella, when not in use, as well as after use. The umbrella cover of the present invention can be readily removed from the cover for use during a rainfall and is easily and conveniently reinserted into the cover after use following a rainfall whether wet or dry.

BACKGROUND OF THE INVENTION

Conventional umbrella cover(s) in present use provide an aesthetic flexible sheath for foldable umbrella(s) within which an umbrella is conveniently stored during dry conditions prior to a rainfall. However, immediately following a rainfall a foldable umbrella cannot be easily reinserted into the cover. For this reason most foldable umbrella covers are generally put aside until the umbrella has dried. This inevitably results in misplacing or losing the cover altogether. A conventional umbrella cover is also unable to absorb water from the umbrella after a rainfall which is another reason a user will generally wait until the wet umbrella has dried off before attempting to reinsert the umbrella.

Although other umbrella cover designs have been proposed to alleviate the problem of not knowing where to place a wet soaked foldable umbrella following use none have received commercial acceptance. Umbrella cover designs which do not offer the simplicity and aesthetics of the inexpensive flexible sheath have failed to receive acceptance in the marketplace. Similarly, the use of two separate covers one for storing the umbrella during dry conditions and another as a temporary holder for a wet umbrella has not received acceptance. The general public is desirous of an umbrella cover which is aesthetic and convenient to use not only for storing and transporting an umbrella when dry but also for reinserting the umbrella when wet, i.e., to provide a place for the umbrella following use.

SUMMARY OF THE INVENTION

The umbrella cover of the present invention is composed of a flexible water resistant material such as nylon and a fastener, preferably a zipper, which is affixed to the flexible material about its entire outer perimeter such that when the zipper is closed the flexible material is configured to provide an enclosure for storing a foldable umbrella and when the zipper is opened the flexible material is reconfigured into a sheet of material which is adapted to be laid flat on a level surface. The folded umbrella may be readily inserted into the cover with the zipper partially opened or placed over the material with the zipper in the fully open position so that by closing the zipper the flexible material is reconfigured to enclose the umbrella wet or dry. The umbrella may be readily removed at any time from the cover by simply opening the zipper. Accordingly, the extent to which the zipper is opened or closed provides control over the removal and reinsertion of the umbrella independent of how wet the umbrella may be. Once the zipper is fully closed the flexible umbrella cover constitutes an enclosure for storing and transporting the umbrella.

According to the preferred embodiment of the present invention the umbrella cover is composed of flexible material having a zipper affixed to its outer perimeter with the zipper arranged in a configuration having an open and closed position such that when the zipper is drawn toward the closed position the flexible material forms an enclosure adapted to hold a folded umbrella for storage and transportation and when the zipper is drawn toward the open position the flexible material is configured into a sheet adapted to be laid flat open on a level surface. With the flexible material laid flat a wet umbrella may be conveniently placed upon its surface wet or dry and by closing the zipper the flexible material is reconfigured into an enclosure for storing the umbrella. Although a zipper is the preferred fastener other fasteners may be used having a similar configuration affixed to the outer perimeter of the material provided the fastener has an open and closed position which enables the material to form an enclosure in the closed position and to form a sheet of material in the open position.

The cover is preferably composed of at least one flexible outer layer of a material which is preferably water resistant such as nylon or a conventional water proof material and has an inner layer or interior liner which is preferably composed of an absorbent material such as cloth or terry cloth. The nylon outer layer forms the exterior of the cover when the fastener or zipper is closed. The inner lining is intended to absorb water from the umbrella if wet.

BRIEF DESCRIPTION OF THE DRAWINGS

Additional advantages of the present invention will become apparent from the following detailed description of the invention when read in conjunction with the accompanying drawings of which.

DETAILED DESCRIPTION OF A PREFERRED EMBODIMENT

Figure 5:
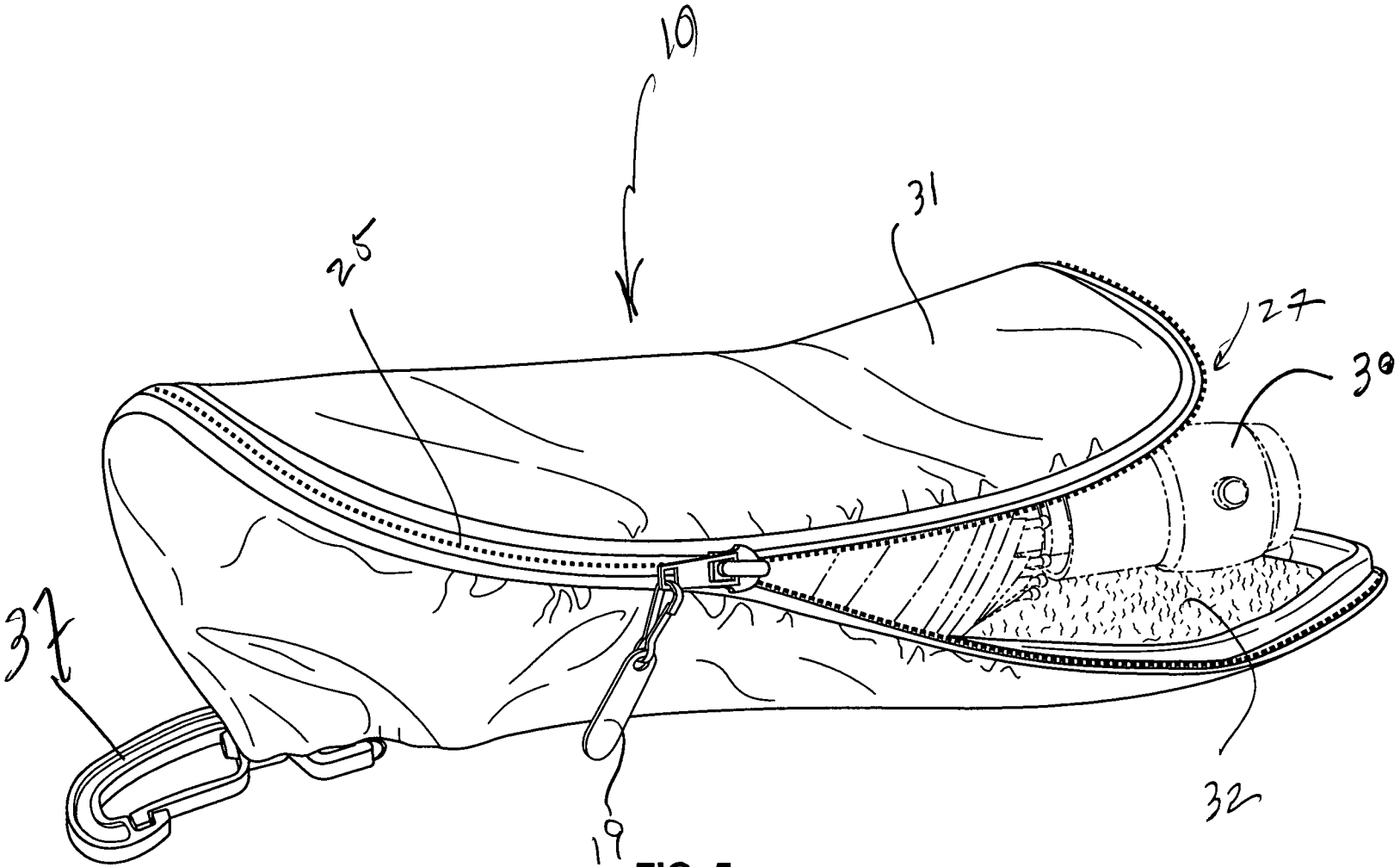
FIG. 5 is another perspective view of the umbrella cover of the present invention similar to FIG. 4 with the zipper shown partially opened exposing a flexible umbrella stored inside the holder.

FIGS. 1-5 depict the preferred embodiment of the umbrella cover or holder 10 of the present invention. The umbrella cover 10 comprises a fastener 12, preferably a zipper, and a water resistant material 14 composed of nylon or a water impervious material. The zipper 12 preferably consists of a first and second row of metal or plastic teeth 16 and 17 which are affixed to the outer perimeter of the material 14 in a configuration forming a closed loop. Any conventional commercial type zipper may be used. The first row of teeth 16 extend from a first position 20, which represents the zipper starting or open position, following the arrow direction in FIG. 2 to a second position 22, which represents the closed position of the zipper 12. The second row of teeth 17 extends from the starting position 20 in an opposite direction as shown by the arrow in FIG. 2 to the second position 22. The row of teeth 16 and 17 interconnect at the first position 20 through a movable sliding member 18 and between the first and second position form a closed loop of teeth. The sliding member 18 represents the body of the zipper 12 and is connected to a grip 19 for manually pulling the sliding member 18 from the starting or open position 20. This causes the teeth from rows 16 and 17 to engage and interlock within the sliding member 18 as the sliding member 18 is pulled leaving a trailing seam 25 of interlocking teeth formed behind the sliding member 18 as the sliding member 18 continues to be drawn toward the closed position 22. Accordingly, by pulling the grip 19 the zipper 12 moves from the open position 20 toward the closed position 22 and the seam 25 configures the material 14 into a geometry defining an enclosure having an elongated central section 26 preferably of a cylindrical configuration with opposite ends 27 and 28. When the zipper 12 is partially open, as shown in FIG. 5, a portion of the central section 26 and one end 27 of the cover 10 remains open for inserting an umbrella 30 into the cover 10. The end 28 of the cover opposite the open end 27 remains closed. The geometry formed by the zipper 12 is determined by the dimensions of the flexible material 14 and the location of the open position 20 and the closed position 22 respectively. The configuration and size of the material 14 and location of the open and closed positions 20 and 21 are predetermined to form an interior cavity which will accommodate a standard size foldable umbrella 30 when the zipper 12 is fully closed as shown in FIG. 5.

The row of teeth 16 and 17 are preferably connected to a strip of fabric 24 which is stitched to the flexible material 14 so that each row of teeth 16 and 17 extend outwardly from the material 14 around the entire perimeter of the material 14 extending from the open position 20 to the closed position 22 and preferably in a closed loop configuration. Pulling the grip 19 moves the siding member 18 to either the open position 20 or the closed position 22.

In the embodiment described in FIGS. 1-5 the zipper when drawn closed configures the material 14 into a geometry defining an enclosure to fully enclose a foldable umbrella 30 as is shown in FIG. 5.

Figure 1:
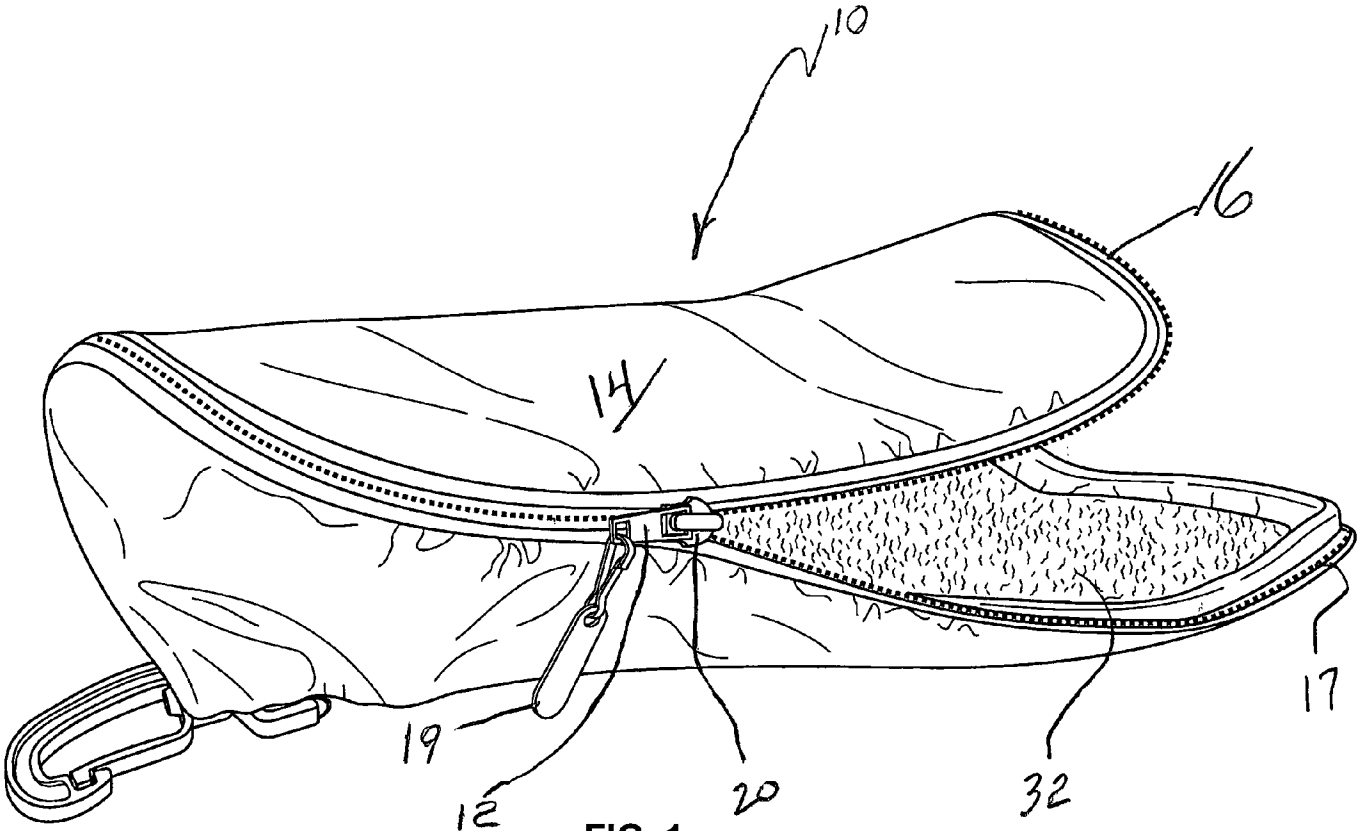
FIG. 1 is a perspective view of the umbrella cover of the present invention with the zipper shown partially opened exposing an interior cavity which forms an enclosure for holding and storing an umbrella.
Figure 2:
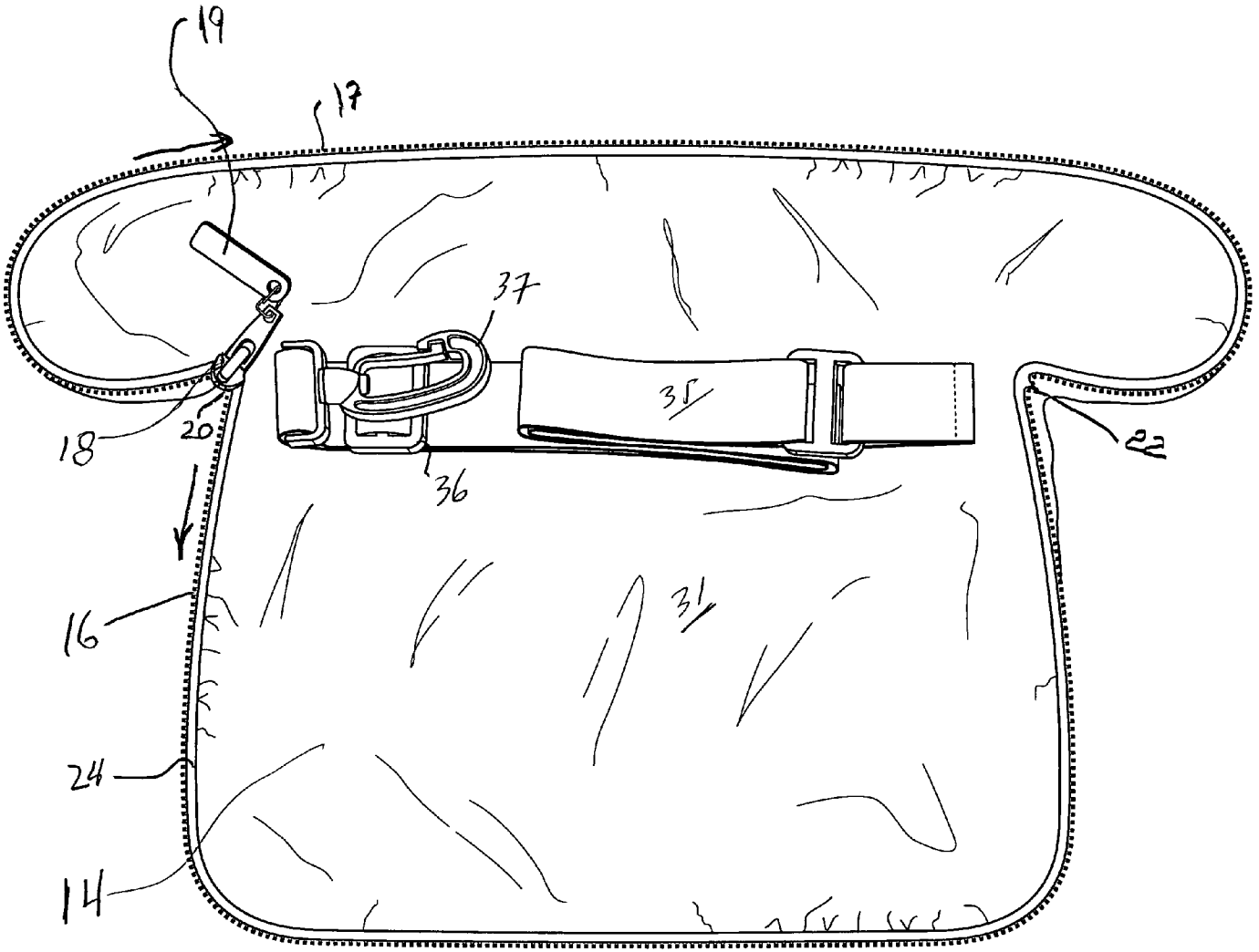
FIG. 2 is a view similar to FIG. 1 with the zipper shown fully opened and the water resistant or water impervious outer surface of the flexible material shown lying flat down and exposed with a strap holder attached to the outer surface.
Figure 3:
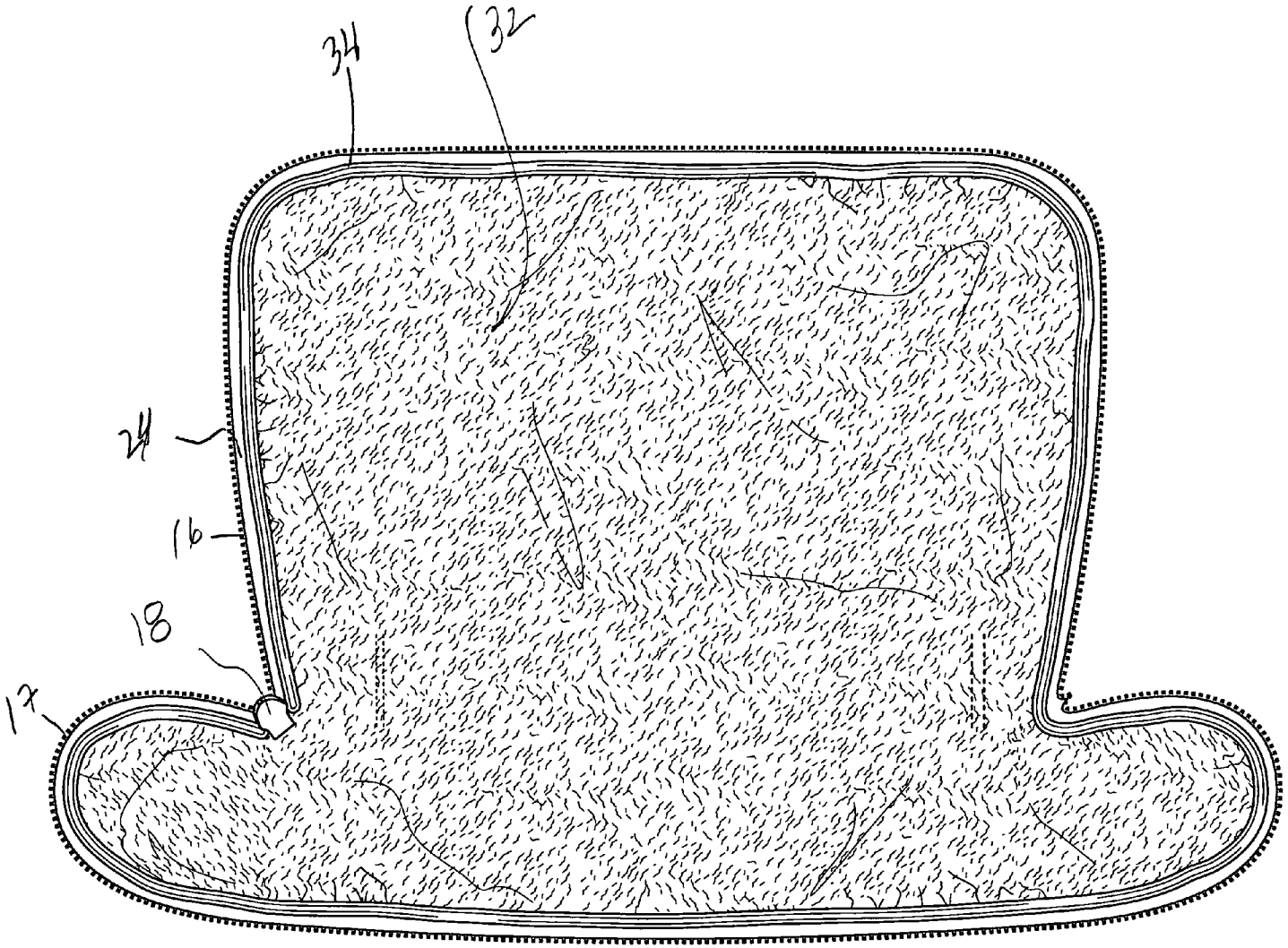
FIG. 3 is a view opposite to that of FIG. 2 showing the interior lining of the cover face up.
Figure 4:
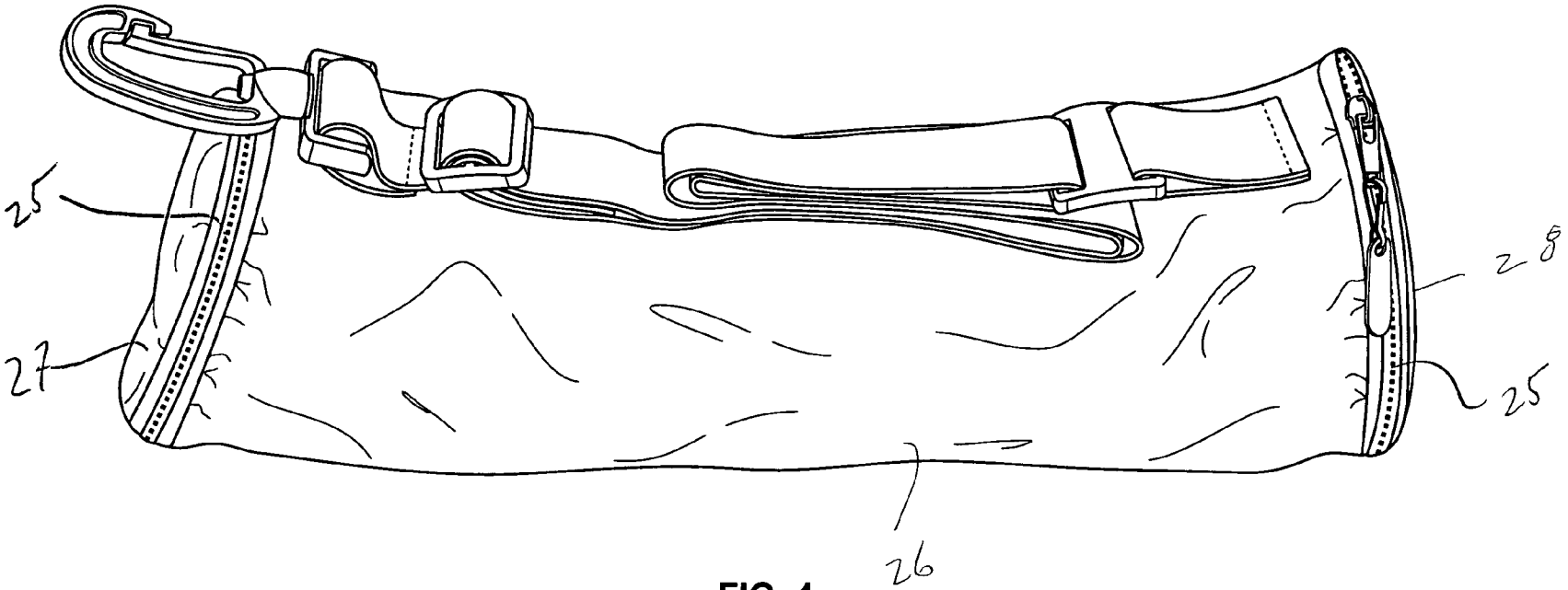
FIG. 4 is a perspective view of the umbrella cover of the present invention in a fully closed position.

The flexible material 14 is preferably composed of two layers having an outer surface 31 composed of water resistant nylon or of another water impervious material and an inner layer 32 representing an inner liner of the cover 10 when the zipper 12 is closed. The inner layer 32 is composed of a water absorbent material such as cloth or terry cloth. In FIG. 5 the zipper 12 is shown partially opened exposing the inner lining 32 with an umbrella 30 located inside the cover 10. By opening the zipper 12 to the fully opened position 20 the flexible material 14 opens into a configuration represented by a sheet of material which can be laid flat down on either side thereof as is shown in FIGS. 2 and 3. FIG. 2 shows the water resistant surface 31 fully exposed and FIG. 3 shows the inner lining 32 fully exposed. A strap 35 is affixed to the outer surface 31 of the material 14 to enable the cover 10 to be held over a shoulder or as a back strap when the buckle 36 of the strap 35 is opened and the strap 35 fully extended. The strap 35 facilitates carrying the cover 10 and a stored umbrella with ones hands free or over the shoulder or back-pack style. The strap 35 has a hook 37 adjacent the buckle 36 which enables the cover 10 and umbrella 30 to be hung up for storage such as in a closet or restaurant when not in use. The hook 37 may also be used for attaching the cover to any convenient holder to prevent loss.

The inner liner 32 should preferably cover the entire interior surface of the cover 10. A narrow strip 34 of nylon material or other water resistant or water impervious material is attached to the strip of fabric 24 overlapping the inner layer 32 along the entire outer perimeter of the cover 10 to form a waterproof seal adjacent the zipper 12 to prevent water from entering from the cover exterior through the zipper 12. The narrow strip 34 forms a narrow overhang partially extending over the lining 32 at the interconnection with the strip 24 to which the row of teeth 16 and 17 are connected to prevent the absorbent material 32 from absorbing water through the zipper 12. The inner lining of water absorbent material 32 will absorb and retain water from a wet umbrella immediately after use. Excess water retained in the absorbent material 32 can readily be rung out upon removal of the umbrella with the zipper in the fully open position or simply allowed to dry by exposure to the atmosphere or placed in sunlight and may even be placed in a dryer at a low heat setting to more quickly dry out.

Although a zipper is the preferred fastener other fasteners may be used in place of or in combination with a zipper. For example a row of buttons and button openings may form the fastener provided the row of buttons and button holes are arranged to extend along the outer perimeter of the material 14 in the same fashion as the zipper 12. Alternatively strips of Velcro may be used in a similar arrangement disposed on opposite sides about the outer perimeter of the flexible material 14 to operate in a fashion equivalent to the operation of the zipper 12 such that when the fastener is closed the material forms the enclosure for the umbrella and when the fastener is opened the flexible material may be laid out flat.

What is claimed is:

1. A cover for holding a foldable umbrella comprising a flexible material having a perimeter defining the boundary formed by the material around its periphery and a zipper fastener affixed to the periphery of the material with the zipper fastener comprising a first and second row of teeth with each row of teeth extending from first and second points on the periphery of the material along two different paths such that the two rows of teeth form a closed loop encircling the entire perimeter of the material wherein when the zipper is moved in one direction from the first point to the second point the physical configuration of the flexible material changes from an open position in which the flexible material lies flat substantially in one plane to a closed position wherein the flexible material is in a configuration forming an enclosure having an elongated central area of substantially cylindrical geometry sized to accommodate the foldable umbrella within the enclosure when the cover is in the closed position and when the zipper fastener is moved back into the open position the flexible material is reconfigured back into a configuration lying flat open on a level surface, wherein the cover further comprises a continuous, single piece inner liner covering the entire inner surface area of the cover with the inner liner composed of a water absorbent material for absorbing water from the foldable umbrella in the closed position when wet and having a strip of relatively narrow material extending around the zipper fastener to form a seal which overhangs a portion of the inner lining about the entire perimeter of the flexible material to prevent water from entering the cover when the zipper fastener is closed.

2. A cover as defined in claim 1 wherein the flexible material is composed of two layers with one layer representing an outer surface composed of either a water resistant or water proof material and the other layer forming the water absorbent inner liner for the cover.

3. A cover as defined in claim 1 wherein the inner liner is composed of a water absorbing fabric.

4. A cover as defined in claim 3 wherein the water absorbing fabric is a terry cloth material.

5. A cover as defined in claim 4 wherein a strap is connected to the outer surface of the cover to facilitate holding the cover with the umbrella stored therein.

6. A cover as defined in claim 5 further comprising a hook to enable the cover to be conveniently attached for storage when not in use and to prevent loss.

7. A cover as defined in claim 1 wherein the zipper fastener further comprises a sliding member engaging the zipper fastener for interconnecting the two rows of teeth as the sliding member moves the zipper from the open to the closed position.

8. A cover as defined in claim 7 wherein the elongated central section has opposite ends which are closed with the zipper fastener in the closed position and with the zipper fastener partially open one end of the elongated section is open for enclosing the umbrella.

* * * * *